US008955375B2

(12) United States Patent
DiFoggio et al.

(10) Patent No.: US 8,955,375 B2
(45) Date of Patent: Feb. 17, 2015

(54) SYSTEM AND METHOD FOR SAMPLING AND ANALYZING DOWNHOLE FORMATION FLUIDS

(75) Inventors: Rocco DiFoggio, Houston, TX (US); Paul Allan Bergren, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 475 days.

(21) Appl. No.: 13/357,753

(22) Filed: Jan. 25, 2012

(65) Prior Publication Data

US 2012/0118040 A1 May 17, 2012

Related U.S. Application Data

(62) Division of application No. 12/351,289, filed on Jan. 9, 2009, now Pat. No. 8,145,429.

(51) Int. Cl.
*E21B 49/08* (2006.01)
*G01N 30/20* (2006.01)
*G01N 30/22* (2006.01)

(52) U.S. Cl.
CPC ..... *E21B 49/081* (2013.01); *E21B 49/087* (2013.01)
USPC ..... 73/152.28; 73/23.41; 73/61.55; 73/64.56

(58) Field of Classification Search
CPC ..... E21B 49/081; E21B 49/087
USPC ..... 73/19.02, 19.1, 23.35, 23.37, 23.41, 73/61.55, 64.56, 152.28; 250/255, 288
See application file for complete search history.

(56) References Cited

U.S. PATENT DOCUMENTS 2,218,155 A * 10/1940 Rusler et al. ..... 73/152.28 X
3,033,286 A * 5/1962 Fast et al. ..... 49/81
3,456,504 A * 7/1969 Bombardieri ..... 73/152.39
3,611,799 A * 10/1971 Davis ..... 73/152.24

(Continued)

FOREIGN PATENT DOCUMENTS

DE 19820626 A1 * 11/1999 ..... H01J 49/04
EP 699819 A2 * 3/1996 ..... E21B 49/08

(Continued)

OTHER PUBLICATIONS

Diesel Progress North American Edition, Oct. 2000. [online]; [retrieved on Jan. 9, 2009]; retrieved from the Internet http://findarticles.com/p/articles/mi_m0FZX/is_10_66/ai_69860770, High-Press, Piezo-Actuated Diesel Fuel Injector From FEV, 2 pages.

(Continued)

*Primary Examiner* — Thomas P Noland
(74) *Attorney, Agent, or Firm* — Cantor Colburn LLP

(57) ABSTRACT

A device for sampling fluid from an earth formation is disclosed. The device includes: an inlet port disposable in fluid communication with the fluid in a borehole; an injector including an injection chamber in fluid communication with the inlet port, the injector configured to receive a portion of the fluid and direct the fluid toward an analysis unit for analyzing constituent materials in the fluid; and a high pressure valve configured to admit the portion of the fluid at a borehole pressure and release the portion of the fluid into the injector, the portion having a volume that is less than or equal to about one microliter. A system and method for analyzing constituents of fluid in a borehole in an earth formation is also disclosed.

20 Claims, 5 Drawing Sheets

(56) References Cited

U.S. PATENT DOCUMENTS

| | | | | |
|---|---|---|---|---|
| 3,951,046 | A | 4/1976 | Lochmann et al. | |
| 4,739,654 | A | 4/1988 | Pilkington et al. | |
| 4,886,359 | A | 12/1989 | Berndt | |
| 5,554,020 | A | 9/1996 | Rao et al. | |
| 5,638,600 | A | 6/1997 | Rao et al. | |
| 6,443,001 | B1 | 9/2002 | Duriez et al. | |
| 6,499,344 | B2 * | 12/2002 | Nelson et al. | 73/152.23 |
| 6,575,719 | B2 | 6/2003 | Manner et al. | |
| 7,063,077 | B2 | 6/2006 | Rodriguez-Amaya et al. | |
| 7,198,105 | B2 * | 4/2007 | Grant et al. | 166/305.1 |
| 7,204,264 | B2 | 4/2007 | Crocker et al. | |
| 7,219,541 | B2 | 5/2007 | DiFoggio | |
| 8,082,780 | B2 * | 12/2011 | Vannuffelen et al. | 49/8 |
| 8,191,416 | B2 * | 6/2012 | Kuchuk et al. | 73/152.41 |
| 8,347,693 | B2 * | 1/2013 | Pindiprolu et al. | 73/54.32 |
| 2002/0028151 | A1 | 3/2002 | Manner et al. | |
| 2005/0284155 | A1 | 12/2005 | Bhatt et al. | |
| 2006/0012265 | A1 | 1/2006 | Bachmaier et al. | |
| 2006/0101905 | A1 | 5/2006 | Bittleston et al. | |
| 2009/0151426 | A1 | 6/2009 | Shah et al. | |
| 2011/0130966 | A1 * | 6/2011 | Zhan et al. | 49/87 |
| 2011/0229071 | A1 * | 9/2011 | Vincelette et al. | 385/13 |
| 2013/0071934 | A1 * | 3/2013 | Indo et al. | 436/28 |
| 2014/0157877 | A1 * | 6/2014 | Abad et al. | 73/61.55 |

FOREIGN PATENT DOCUMENTS

| | | | | |
|---|---|---|---|---|
| EP | 781893 | A2 * | 7/1997 | E21B 49/08 |
| EP | 2028341 | A1 | 2/2009 | |
| WO | WO 0065200 | A1 * | 11/2000 | E21B 49/081 |

OTHER PUBLICATIONS

Duggirala, et al. "A Pyroelectric-Piezoelectric Valve for Integrated Microfluidics". The 12th International Conference on Solid State Sensors, Actuators and Microsystems, Boston, Jun. 8-12, 2003. pp. 1554-1557.

HPLC Essentials, Genuine Restek Replacement Parts for HPLC Systems. [online]; [retrieved on Jan. 9, 2009]; retrieved from the Internet www.restek.com, 8 pages, copyright 2005.

Injectors. [online]; [retrieved on Jan. 9, 2009]; retrieved from the Internet http://www.boschautoparts.com/Products/DieselParts/Injectors.htm , 2 pages.

Luong, et al. "Innovations in High-Pressure Liquid Injection Technique for Gas Chromatography: Pressurized Liquid Injection System". Journal of Chromatographic Science, vol. 41, Nov./ Dec. 2003. pp. 550-559.

Precision Inlet Systems. Monitor Instruments. 2005 Monitor Instruments Company LLC. 2 pages.

Product Support, VICI Valco Instruments Co. Inc. VICI AG International. [online]; [retrieved on Jan. 9, 2009]; retrieved from the Internet http://www.vici.com/support/app/app8j.php, Microvolume sample—injection Two position valve application—4 port microvolume sample injector, 2005 copyright, 1 page.

Notification of Transmittal of the International Search Report and the Written Opinion of the International Searching Authority, or the Declaration; PCT/US2010/020022; Aug. 13, 2010.

Yanqiao Xiang, et al., "Pseudolinear Gradient Ultrahigh-Pressure Liquid Chromatography Using an Injection Valve Assembly", Feb. 2006, Analytical Chemistry, vol. 78, No. 3, pp. 858-864.

* cited by examiner

SYSTEM AND METHOD FOR SAMPLING AND ANALYZING DOWNHOLE FORMATION FLUIDS

CROSS-REFERENCE TO RELATED APPLICATIONS

This application is a divisional of co-pending U.S. patent application Ser. No. 12/351,289, filed Jan. 9, 2009, entitled "SYSTEM AND METHOD FOR SAMPLING AND ANALYZING DOWNHOLE FORMATION FLUIDS", by Flanagan et al., which is hereby incorporated herein by reference in its entirety.

BACKGROUND OF THE INVENTION

During hydrocarbon drilling and recovery operations, fluid is often extracted from a drilled wellbore to identify gases present in the fluid in order to analyze formation and/or reservoir characteristics. The fluid is generally removed and sent to a surface location for analysis. However, such surface analysis may delay evaluation of a reservoir prospect by requiring that the fluid samples be removed and sent to a surface lab for analysis, which could take months. Downhole analysis units allow for real time fluid analysis and reduce this delay.

Introducing representative samples into a downhole analysis system is important in providing accurate compositional analysis data. If the inlet system selectively passes some constituents over others, then any measurement of the relative distribution of constituents will be in error unless this selectivity can be quantified and a correction made for it. Therefore, an inlet system that transmits the same distribution of constituents as were originally present is preferred. In a downhole system, introducing representative samples can be very difficult, thus making accurate real-time downhole fluid analysis difficult to accomplish due to the generally inhospitable conditions and space and design restrictions inherent in a downhole environment.

BRIEF SUMMARY OF THE INVENTION

A device for sampling fluid from an earth formation includes: an inlet port disposable in fluid communication with the fluid in a borehole; an injector including an injection chamber in fluid communication with the inlet port, the injector configured to receive a portion of the fluid and direct the fluid toward an analysis unit for analyzing constituent materials in the fluid; and a high pressure valve configured to admit the portion of the fluid at a borehole pressure and release the portion of the fluid into the injector, the portion having a volume that is less than or equal to about one microliter.

A system for analyzing constituents of fluid in a borehole in an earth formation includes: an inlet port in fluid communication with the fluid in the borehole; an injector including an injection chamber in fluid communication with the inlet port, the injector configured to receive a selected portion of the fluid; a high pressure valve in fluid communication with the injection chamber, the high pressure valve configured to withstand a pressure of at least 10,000 psi and release the selected portion of the fluid into the injector, the selected portion having a volume that is less than or equal to about one microliter; a vacuum chamber in fluid communication with the nozzle, the vacuum chamber being at least partially evacuated of gases; and an analysis unit disposed in the vacuum chamber, the analysis unit configured to receive the fluid and detect constituent materials in the fluid.

A method of analyzing constituents of fluid in a borehole in an earth formation includes: receiving the fluid via an inlet port from the borehole; actuating a valve to inject a selected portion of the fluid into an injector, the selected portion having a volume that is less than or equal to about one microliter, the injector including an injection chamber and a nozzle in fluid communication with the inlet port; advancing the selected portion through the injector; and receiving the fluid in an analysis chamber and detecting constituent materials in the fluid via an analysis unit disposed in the analysis chamber.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

Figure 1:
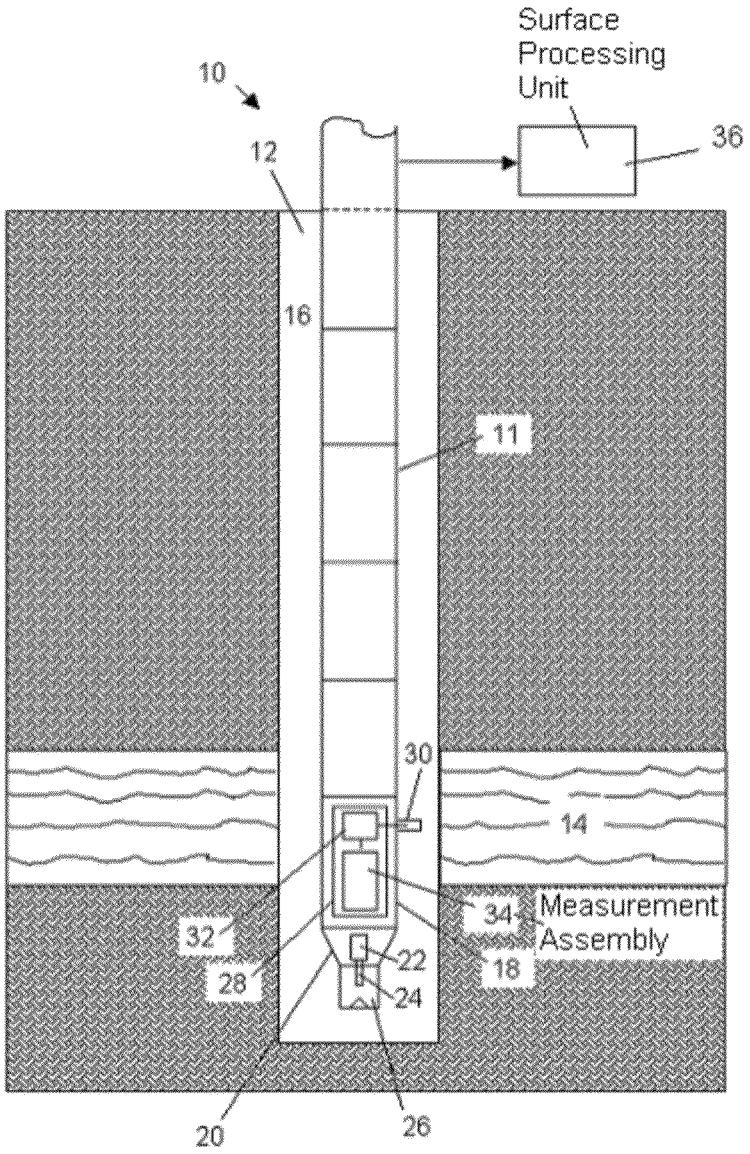
FIG. 1 depicts an embodiment of a well logging and/or drilling system.

Referring to FIG. 1, an exemplary embodiment of a well logging and/or drilling system 10 includes a drillstring 11 that is shown disposed in a borehole 12 that penetrates at least one earth formation 14 during a drilling, well logging and/or hydrocarbon production operation. The drillstring 11 includes a drill pipe, which may be one or more pipe sections or coiled tubing, for example. A borehole fluid 16 such as a drilling fluid or drilling mud may be pumped through the drillstring 11 and/or the borehole 12. The well drilling system 10 also includes a bottomhole assembly (BHA) 18.

As described herein, "borehole" or "wellbore" refers to a single hole that makes up all or part of a drilled well. As described herein, "formations" refer to the various features and materials that may be encountered in a subsurface environment. Accordingly, it should be considered that while the term "formation" generally refers to geologic formations of interest, that the term "formations," as used herein, may, in some instances, include any geologic points or volumes of interest (such as a survey area). In addition, it should be noted that "drillstring" as used herein, refers to any structure suitable for lowering a tool through a borehole or connecting a drill to the surface, and is not limited to the structure and configuration described herein. For example, the drillstring 11 may be configured as a wireline connected to a downhole tool. Furthermore, "borehole fluid" or "formation fluid" as described herein refers to a fluid introduced into the borehole via a surface source and/or a source within the formation 14.

In one embodiment, the BHA 18 includes a drill bit assembly 20 and associated motors adapted to drill through earth formations. In one embodiment, the drill bit assembly 20 includes a steering assembly including a steering motor 22 configured to rotationally control a shaft 24 connected to a drill bit 26. The shaft is utilized in geosteering operations to steer the drill bit 26 and the drillstring 11 through the formation 14.

The BHA 18, in one embodiment, includes a downhole measurement tool 28 configured as a high pressure, high temperature microsampler for real-time detection, classification and analysis of gases trapped in a formation fluid sample. The measurement tool includes one or more analysis units such as a mass spectrometer, a gas chromatograph, and a high pressure liquid chromatograph. Although the downhole tool 28 is described in conjunction with a drilling system, the downhole tool 28 can be utilized with any system disposed in a borehole, such as a hydrocarbon production system and a logging system including a measurement-while-drilling (MWD) or logging-while-drilling (LWD) system. In one embodiment, the downhole tool 28 is incorporated into a borehole fluid evaluation system such as the Reservoir Characterization Instrument$^{SM}$ (RCI$^{SM}$) system manufactured by Baker Hughes Incorporated.

The downhole tool 28 is capable of detecting the presence and concentration of one or more of various constituent gases or other materials. Examples of such constituents include methane, ethane, propane, butane, hydrogen sulfide, carbon dioxide and oil-based mud filtrate in formation fluid. The downhole tool 28 is capable of vaporizing or atomizing and transferring a very small, e.g., sub-microliter, amount of a very high pressure formation fluid into a very low (i.e., atmospheric, vacuum or near-vacuum) pressure analysis chamber. In one embodiment, the aliquot of sample that is injected into the chamber is kept extremely small so as not to overwhelm the vacuum system or to make it difficult to purge a previous sample before introducing the next sample.

The downhole tool 28 includes an inlet probe 30 that is extendable from the drillstring 11 to retrieve a sample of formation fluid, a collection chamber 32 in fluid communication with the inlet probe 30, and a measurement assembly 34 configured to pressurize and vaporize or atomize a sample of the formation fluid, and analyze the constituent gases present within the sample. The inlet probe 30 is extendable to collect fluid located in the annulus between the drillstring 11 and the borehole 12 and/or fluid located in the formation 14 or a reservoir in the formation 14.

The downhole tool 28 includes a processing chip or other electronics unit to receive, analyze, store and or communicate information regarding the fluid constituency. In one embodiment, the electronics unit is configured to communicate with a remote processor such as a surface processing unit 36. In one embodiment, the surface processing unit 36 is configured as a surface drilling control unit which controls various production and/or drilling parameters such as rotary speed, weight-on-bit, fluid flow parameters, pumping parameters and others and records and displays real-time formation evaluation data. In addition, the surface processing unit 36 may be configured as a measurement assembly control unit to control operation of the measurement assembly 34 remotely. The BHA 18 and/or the downhole tool 28 is configured to communicate with the surface processing unit 36 via any suitable connection, such as a wired connection including a wireline or wired pipe, a fiber optic connection, a wireless connection and mud pulse telemetry.

In one embodiment, the surface processing unit 36 includes components as necessary to provide for storing and/or processing data collected from the downhole tool 28. Exemplary components include, without limitation, at least one processor, storage, memory, input devices, output devices and the like.

Figure 2:
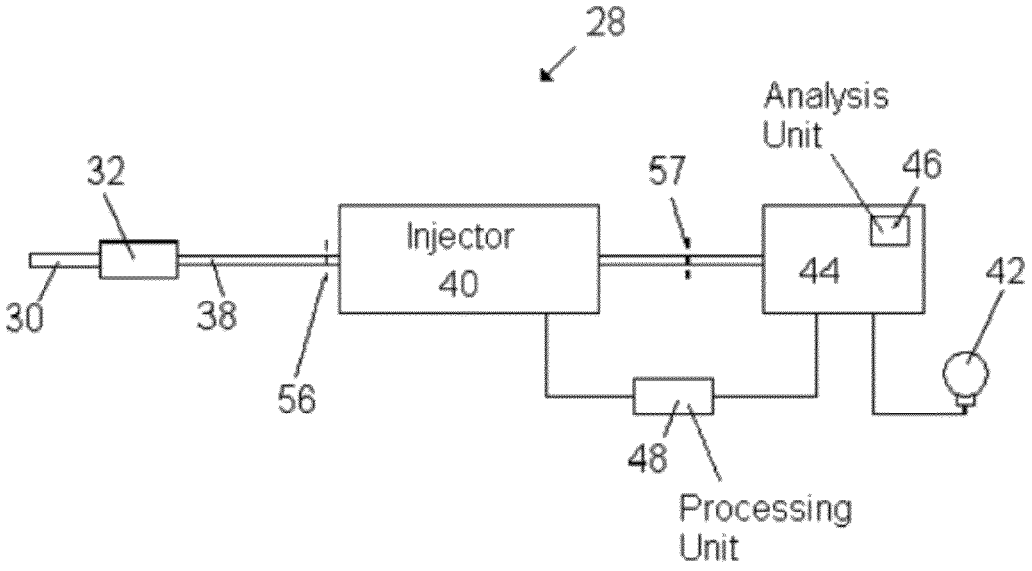
FIG. 2 is an illustration of a formation fluid measurement tool of the system of FIG. 1.

Referring to FIG. 2, the downhole measurement tool 28 includes the inlet port 30 connected to the collection chamber 32 for receiving the formation fluid, which is in turn connected via an inlet conduit 38 to a high pressure sampling unit or injector 40. The injector 40 is configured to vaporize or atomize a sample of the formation fluid. The injector 40 receives a portion of the formation fluid, which may have a pressure in a range of about 8,000 to about 12,000 psi. The high pressure fluid enters the inlet conduit 38 and forces a sample of the formation fluid into the injector 40. In one embodiment, the fluid pressure in the injector 40 is at least about 10,000 psi. In one embodiment, an exemplary injector 40 is configured similar to a diesel engine high-pressure fuel injector.

In one embodiment, the injector 40 is connected in fluid communication with an analysis chamber, i.e., a vacuum chamber 44, which receives the atomized fluid sample. The vacuum chamber 44 is maintained at a selected pressure, such as an atmospheric pressure or a lower pressure. The vacuum chamber 44 is at least partially evacuated of air or other gases by a vacuum pump 42 to form at least a partial vacuum prior to introduction of the fluid sample. An analysis unit 46 such as a mass spectrometer (MS) or gas chromatograph (GC) unit is disposed within the analysis chamber 44. The analysis unit 46 is exposed to the atomized fluid sample and detects the existence and/or concentration of various constituent materials.

In one embodiment, a processing unit 48 including suitable electronics is configured as a control unit to control the operation of the injector 40 and/or the analysis unit 46. The processing unit 48 is configured to receive measurement data, store the data and/or transmit the data to a remote location such as the surface processing unit 36.

Figure 3:
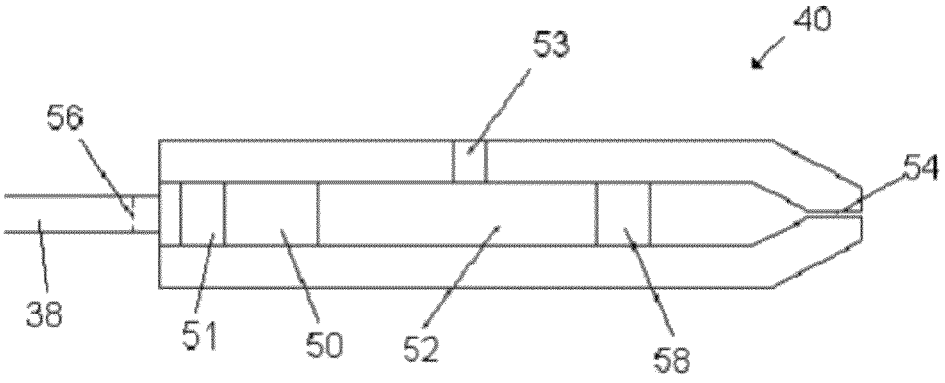
FIG. 3 is an illustration of an embodiment of an injector of the measurement tool of FIG. 2.

Referring to FIG. 3, the injector 40 includes a high pressure valve 50 in fluid communication with an injection chamber 52, which is in turn in fluid communication with a nozzle 54. In one embodiment, the nozzle 54 has a diameter small enough to atomize the fluid sample introduced into the injection chamber 52.

The nozzle 54 has a very small diameter sufficient to atomize the fluid sample as it is forced through the nozzle 54 into the vacuum chamber 44. In one embodiment, the injection chamber 52 is designed to collect samples of fluid having a volume of about one microliter, i.e., one cubic millimeter, or less. In another embodiment, the injection chamber 52 is designed to collect fluid samples having a volume between 0.2 and one microliter.

The valve 50 may have any configuration suitable for allowing the delivery of a selected volume of the formation fluid. In one embodiment, the valve 50 is configured to withstand pressures greater than 10,000 psi. In one embodiment, the valve 50 is actuated via an actuator 51 or any suitable mechanism, such as an electromagnetic (via a motor or solenoid), piezoelectric, thermal, mechanical, pneumatic and hydraulic mechanism. One example of the valve 50 is a pressure valve configured to automatically open in response to the fluid pressure exceeding a selected threshold.

In one embodiment, the valve 50 is actuatable to allow the passage of a sample of fluid into the injection chamber 52 having a volume of about one microliter, i.e., one cubic millimeter, or less. In another embodiment, the valve 50 is actuatable to allow the passage of a sample of fluid having a volume between 0.2 and one microliter.

In one embodiment, the injector 40 includes a nozzle bypass valve 53 to allow rapid flushing of any old sample that is retained in the injector body into a waste chamber or other location, and thereby to allow the injector body to refill quickly with an entirely new sample.

Figure 4:
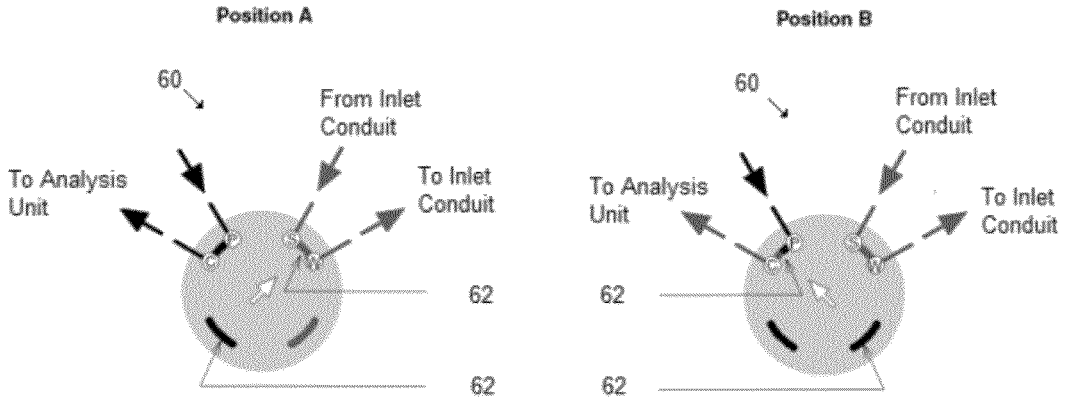
FIG. 4 is an illustration of another embodiment of the injector of the measurement tool of FIG. 2.

Referring to FIG. 4, in one embodiment, the injector 40 includes an ultra-low dead volume valve, which allows for delivery of the selected volume, such as a single droplet (e.g., 10 nanoliters), without the need for a chamber to admit a larger volume of fluid than the selected volume. Such an injector reduces or eliminates dead volume of the sample (i.e., a portion of the sample not used) and accordingly reduces or eliminates the need to flush out any chambers between samples.

The injector 40 includes a valve 60 having one or more slots or passages 62 that are engraved or otherwise located on the surface of the valve 60. Each passage 62 has a selected volume corresponding to the desired volume of the sample. For example, each passage has a volume of approximately 10 nanoliters. With this configuration, a single droplet can be injected into the vacuum chamber 44 without excess fluid volume that would otherwise need to be flushed before an additional sample is taken.

The valve includes two conduits that allow a sample of the fluid to be collected and transferred to an analysis unit. In one embodiment, the valve 60 includes a first conduit in fluid communication with the collection chamber 32 and/or the inlet conduit 38 for receiving the formation fluid, and a second conduit in fluid communication with the vacuum chamber 44.

At least a portion of the valve 60 is rotatable to remove a sample of the fluid from the inlet conduit 38 and transfer the sample to the vacuum chamber 44. In a first position (Position A), the passage 62 is positioned in fluid communication with the inlet conduit 38. When the valve 60 is rotated to a second position (Position B), the passage 62 retains a sample having only a desired volume of the fluid (e.g., a single droplet), and transfers the sample to a location that is in fluid communication with the vacuum chamber 44. Optionally, at least a second passage 62 is positioned on the valve 60, so that when the valve 60 is in the second position, the second passage 62 is positioned in fluid communication with the inlet conduit 38 so that fluid can continue to flow through the valve 60 without substantial interruption.

In one embodiment, the downhole tool 28 further includes a filter 56 to prevent the entry of particulate matter or other solids from entering the injector 40. In another embodiment, a second filter 57 is disposed between the nozzle 54 and the analysis chamber 44. An example of such a filter includes a porous metal filter. Another example includes an activated charcoal filter, which could be used between the nozzle 54 and the analysis chamber 44 to trap heavy components of crude oil such as asphaltenes so that they do not enter the gas chromatograph or mass spectrometer analysis unit 46.

The injector 40 optionally includes a check valve 58 or other one-way valve to prevent fluid from flowing in the injection chamber 52 toward the conduit 38. The check valve 58 may be any suitable one-way valve capable of withstanding pressures of the injector chamber 52. An example of such a one-way valve is a HPLC check valve manufactured by Analytical Scientific Instruments, Inc. (ASI). Such check valves are capable of withstanding pressures up to 12,000 psi.

One embodiment of the valve 50 is a piezoelectric actuated valve, such as a piezoelectric actuated needle valve, which is provided to apply fast and accurate valve actuation. The valve 50 includes a piezoelectric material such as a plurality of ceramic platelets that expand in response to application of a selected voltage to open the valve. Such piezoelectric actuators allow for the valve to be opened within milliseconds and allow for very small sample sizes, such as sample sizes of less than one microliter, to be introduced into the injector 40 and subsequently into the vacuum chamber 44.

One embodiment of the valve 50 includes a piezo-actuator and an optional servomechanism such as a three-way servo valve, which is capable of allowing small quantities into the injection chamber 52, such as quantities of less than one microliter, while maintaining a repeatable injection quantity under high pressures such as 23,000 psi.

An example of a high pressure valve is described in Rajesh Duggirala et al., "A Pyroelectric—Piezoelectric Valve for Integrated Microfluidics", SonicMEMS Laboratory, School of Electrical and Computer Engineering, The 12th International Conference on Solid State Sensors, Actuators and Microsystems, Boston, Jun. 8-12, 2003, the description of which is hereby incorporated by reference in its entirety. This high pressure valve is a low voltage and low power microvalve that is activatable either electrically by an inverse piezoelectric effect or thermally by a pyroelectric effect.

An example of a high pressure valve is a high pressure liquid chromatography (HPLC) valve. Another example of a high pressure valve is that utilized in the pressurized liquid injection system (PLIS) from Transcendent Enterprises Incorporated of Alberta, Canada. PLIS systems are described in Luong et al., "Innovations in High-Pressure Liquid Injection Technique for Gas Chromotography: Pressurized Liquid Injection System", Journal of Chromatographic Science, Vol. 41, November/December 2003, the description of which is hereby incorporated by reference in its entirety.

Other examples of high pressure valves include those utilized in Ultra performance liquid chromatography (UPLC) UPLC is a liquid chromatography technique that utilizes pressures of up to 15,000 psi. Accordingly, injection valves utilized in these systems are built for pressures up to 15,000 psi. Such valves are manufactured by, for example, CTC Analytics AG and JASCO Benelux BV.

A further example of a high pressure injection valve is described in Xiang et al., "Pseudolinear Gradient Ultrahigh-Pressure Liquid Chromatography Using an Injection Valve Assembly," Analytical Chemistry, 78 (3), 858-864, 2006, the description of which is hereby incorporated by reference in its entirety. This injection valve is useful in ultrahigh pressure liquid chromatography (UHPLC), and can operate at pressures of up to 30,000 psi. This valve includes six miniature electronically controlled needle valves to provide volumes as small as several tenths of a nanoliter.

Another example of a suitable valve is a "freeze-thaw" valve, which is utilized to control fluid flow by freezing or thawing the fluid in a selected portion of a conduit. The freeze-thaw valve allows for fluid control in small conduits, and is operable in high pressure systems. For example, such valves can withstand pressure gradients greater than 10,000 psi per millimeter. In one embodiment, the freeze-thaw valve includes a metal or other material having a melting point greater than the borehole temperature.

Figure 5:
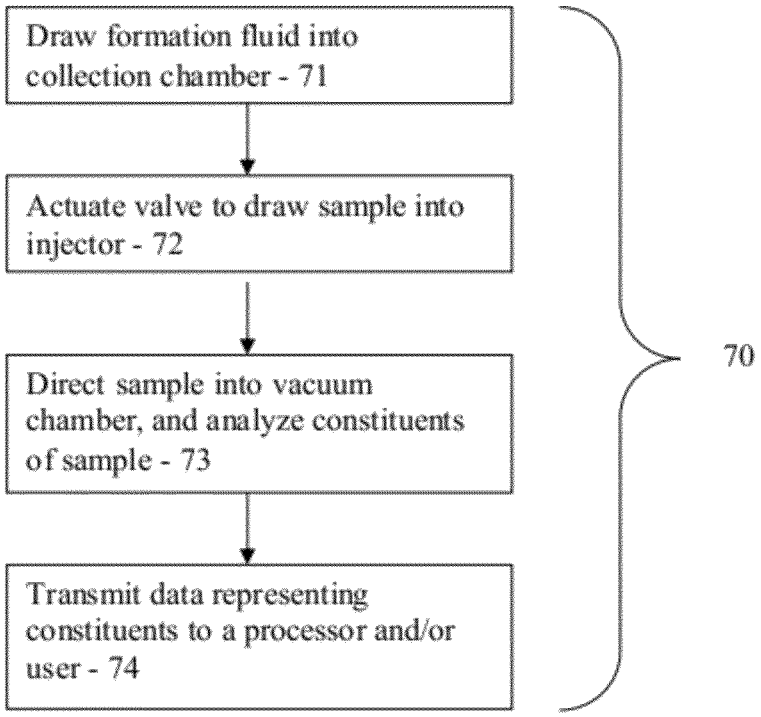
FIG. 5 is a flow chart providing an exemplary method of analyzing constituents of fluid in a borehole in an earth formation.

FIG. 5 illustrates a method 70 of analyzing constituents of fluid in a borehole in an earth formation. The method 70 is used in conjunction with the downhole tool 28 and the control unit 48 and/or the surface processing unit 36, although the method 70 may be utilized in conjunction with any suitable combination of processors and fluid atomizing devices. The method 70 includes one or more stages 71, 72, 73 and 74. In one embodiment, the method 70 includes the execution of all of stages 71-74 in the order described. However, certain stages may be omitted, stages may be added, or the order of the stages changed.

In the fist stage 71, formation fluid is drawn into the inlet probe 30 and into the collection chamber 32. In one embodiment, the formation fluid has a pressure of at least about 8,000 psi.

In the second stage 72, a sample of the formation fluid is drawn into the injector by actuating the valve 50 and/or the valve 60. In one embodiment, the valve 50 is actuated to draw a volume of about one microliter or less into the injector.

In the third stage 73, the fluid is atomized or vaporized as it passes through the nozzle 54 and enters the vacuum chamber 44, and the resulting vapor is exposed to the analysis unit 46 which analyzes the vapor to detect the components and relative concentrations thereof. In one embodiment, the fluid is received by the valve 60 and a single droplet is transferred to the vacuum chamber 44. This may be performed via the control unit 48. In one embodiment, a suitable vacuum pump is utilized to reduce the pressure in the analysis chamber 44 after each sample is injected and before the next sample is injected to reduce or minimize cross contamination of samples.

In the fourth stage 74, data representing the vapor constituents is transmitted to the surface processing unit 36, another suitable processor and/or to a user.

Figure 6:
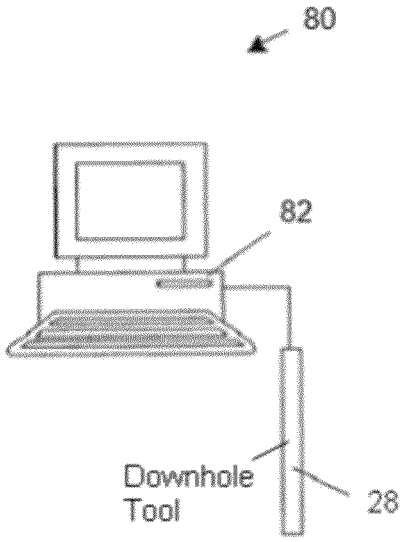
FIG. 6 is an illustration of a system for analyzing constituents of fluid in a borehole in an earth formation.

Referring to FIG. 6, there is provided a system 80 for analyzing constituents of fluid in a borehole in an earth formation. The system 80 may be incorporated in a computer 82 or other processing unit capable of receiving data from the downhole tool 28. Exemplary components of the system 80 include, without limitation, at least one processor, storage, memory, input devices, output devices and the like. As these components are known to those skilled in the art, these are not depicted in any detail herein.

Generally, some of the teachings herein are reduced to instructions that are stored on machine-readable media. The instructions are implemented by the computer 82 and provide operators with desired output.

The systems and methods described herein provide various advantages over prior art techniques. The measurement tool described herein is capable of atomizing or vaporizing a very small amount of formation fluid to accurately analyze the constituent components of the fluid downhole and in real-time. The configuration of the tool allows for use in a downhole environment without compromising accuracy. In addition, in contrast to techniques that utilize membranes as the inlet, the sample inlet described herein provides a useful sample for MS or GC having the same relative amounts of each component as the formation fluid. This is particularly useful for easily identifying the relative amounts of multiple gases or vapors. In addition, the measurement tool allows for a repeatable way to collect a known size of the sample to assess the absolute as well as relative concentrations of each component. Also, unlike a membrane, the measurement tool utilizing a direct sample injection system does not preferentially transmit some components of the sample relative to other components, so it does not introduce a distortion in the relative concentrations that has to be calibrated out.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing aspects of the teachings herein. For example, a sample line, sample storage, sample chamber, sample exhaust, pump, piston, power supply (e.g., at least one of a generator, a remote supply and a battery), vacuum supply, pressure supply, refrigeration (i.e., cooling) unit or supply, heating component, motive force (such as a translational force, propulsional force or a rotational force), magnet, electromagnet, sensor, electrode, transmitter, receiver, transceiver, controller, optical unit, electrical unit or electromechanical unit may be included in support of the various aspects discussed herein or in support of other functions beyond this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method of analyzing constituents of fluid in a borehole in an earth formation, the method comprising:

receiving the fluid via an inlet port from the borehole;

actuating a valve to inject a selected portion of the fluid into an injector, the selected portion having a volume that is less than or equal to about one microliter, the injector including an injection chamber and a nozzle in fluid communication with the inlet port, the injection chamber having a volume that is at least substantially equal to the volume of the selected portion of the fluid;

advancing the selected portion through the injector; and receiving the fluid in an analysis chamber and detecting constituent materials in the fluid via an analysis unit disposed in the analysis chamber.

2. The method of claim 1, wherein the injection chamber has a volume that is at least substantially equal to the volume of the selected portion of the fluid.

3. The method of claim 1, wherein the analysis chamber is a vacuum chamber that is at least partially evacuated of gases.

4. The method of claim 1, wherein advancing the selected portion includes atomizing the selected portion.

5. A method of analyzing constituents of fluid in a borehole in an earth formation, the method comprising:

receiving the fluid via an inlet port from the borehole;

actuating a valve to inject a selected portion of the fluid into an injection chamber of an injector, the injection chamber having a volume that is at least substantially equal to the volume of the selected portion of the fluid;

advancing the selected portion through the injector; and receiving the fluid in an analysis chamber and detecting constituent materials in the fluid.

6. The method of claim 5, wherein the selected portion has a volume that is less than or equal to about one microliter.

7. The method of claim 5, wherein the analysis chamber is a vacuum chamber that is at least partially evacuated of gases.

8. The method of claim 5, wherein advancing the selected portion includes atomizing the selected portion.

9. The method of claim 5, wherein the valve is configured to inject the selected portion of the fluid at a borehole pressure.

10. The method of claim 9, wherein the borehole pressure is at least 8,000 psi.

11. The method of claim 5, wherein detecting is performed via an analysis unit disposed in the analysis chamber.

12. The method of claim 5, wherein detecting is performed via an analysis unit including at least one of a mass spectrometer and a gas chromatograph.

13. The method of claim 5, wherein the valve includes an actuator selected from at least one of a piezoelectric actuator, an electromagnetic actuator and a pressure actuator.

14. The method of claim 5, wherein the valve is selected from at least one of a high pressure liquid chromatography (HPLC) valve and a needle valve.

15. The method of claim 5, wherein the injection chamber includes a one-way valve configured to prevent a flow of fluid toward the inlet port.

16. A method for analyzing constituents of fluid in a borehole in an earth formation, the system comprising:

receiving the fluid via an inlet port from the borehole;

actuating a valve to inject a selected portion of the fluid into an injection chamber of an injector, the selected portion having a volume that is less than or equal to about one microliter, the injection chamber having a volume that is at least substantially equal to the volume of the selected portion of the fluid, advancing the selected portion from the injection chamber to a vacuum chamber, the vacuum chamber being at least partially evacuated of gases; and detecting constituent materials in the fluid.

17. The method of claim 16, wherein detecting is performed via an analysis unit disposed in the vacuum chamber.

18. The method of claim 16, wherein the valve is configured to withstand a pressure of at least 10,000 psi.

19. The method of claim 16, wherein the injection chamber has a volume that is at least substantially equal to the volume of the selected portion of the fluid.

20. The method of claim 16, wherein the injection chamber includes a one-way valve configured to prevent a flow of fluid toward the inlet port.

* * * * *